US008651710B2

(12) United States Patent
Wang

(10) Patent No.: US 8,651,710 B2
(45) Date of Patent: Feb. 18, 2014

(54) DETACHABLE LAMP

(75) Inventor: Chin-Wen Wang, Pingzhen (TW)

(73) Assignees: Chin-Wen Wang, Taoyuan County (TW); Leader Trend Technology Corp., Taoyuan County (TW)

( * ) Notice: Subject to any disclaimer, the term of this patent is extended or adjusted under 35 U.S.C. 154(b) by 183 days.

(21) Appl. No.: 13/442,323

(22) Filed: Apr. 9, 2012

(65) Prior Publication Data

US 2013/0265783 A1 Oct. 10, 2013

(51) Int. Cl.
*F21V 21/088* (2006.01)

(52) U.S. Cl.
USPC ..... 362/374; 362/649

(58) Field of Classification Search
CPC ..... F21V 21/088
USPC ..... 362/249.02, 374, 649
See application file for complete search history.

(56) References Cited

U.S. PATENT DOCUMENTS

| | | | | |
|---|---|---|---|---|
| 6,461,025 | B1 * | 10/2002 | Payne | 362/374 |
| 8,267,550 | B2 * | 9/2012 | Wang | 362/294 |
| 2004/0213002 | A1 * | 10/2004 | Wu | 362/382 |
| 2010/0103693 | A1 * | 4/2010 | Addario | 362/549 |
| 2013/0148338 | A1 * | 6/2013 | Chen et al. | 362/183 |

* cited by examiner

*Primary Examiner* — Stephen F Husar
*Assistant Examiner* — James Cranson, Jr.
(74) *Attorney, Agent, or Firm* — Chun-Ming Shih; HDLS IPR Services

(57) ABSTRACT

A detachable lamp includes a seat, a fastening mechanism and a lighting module. The fastening mechanism includes a rotary latch having a stem and a latching portion extending from the stem. The lighting module is disposed on the seat corresponding by the fastening mechanism and includes a frame and an LED assembly received in the frame. The frame has an engaging member for being fastened by the latching portion. Thereby, the lighting module can be detachably mounted on the seat.

20 Claims, 18 Drawing Sheets

DETACHABLE LAMP

BACKGROUND OF THE INVENTION

1. Technical Field

The invention relates to lamps, particularly to detachable lamps.

2. Related Art

Installation of most LED lamps must rely on professional technicians. Those professional technicians are also required when the LED lamps need to be repaired or replaced. The technicians must further overcome a size problem if the lamp to be replaced is different from the new one in size. This is uneconomical and complicated.

A conventional LED lamp includes a lamp body, a lighting module and two depressors. The lighting module is disposed in the lamp body and the depressors are separately connected on the lamp body. When installing, the ceiling or wall must be drilled to form a hole first and then press the LED lamp into the hole so that the LED lamp can be fixed in the hole by the depressors pressing the edge of the hole.

However, such an LED lamp has drawbacks as follows:

1. The ceiling or wall must be drilled to receive the LED lamp. It needs a cost to hire a technician.

2. When the LED lamp fails, it needs to be completely removed and replaced with a new one. This will cause a waste of cost and material.

3. When the LED lamp needs to be replaced with a new one with different size, the new lamp is very hard to be installed into the original hole.

SUMMARY OF THE INVENTION

An object of the invention is to provide a detachable lamp which uses a fastening mechanism to fasten a lighting module onto a seat so that the lighting module can be simply and fast installed or removed.

To accomplish the above object, the detachable lamp of the invention includes a seat, a fastening mechanism and a lighting module. The fastening mechanism includes a rotary latch having a stem and a latching portion extending from the stem. The lighting module is disposed on the seat corresponding by the fastening mechanism and includes a frame and an LED assembly received in the frame. The frame has an engaging member for being fastened by the latching portion.

To accomplish the above object, the detachable lamp of the invention includes: a seat, fastening mechanism and a lighting module. The fastening mechanism includes a rotary latch having a stem and a latching portion extending from the stem. The lighting module is disposed on the seat corresponding by the fastening mechanism and includes a frame, a vapor chamber received in the frame and a light emitting diode (LED) assembly being in contact with the vapor chamber. The frame has an engaging member for being fastened by the latching portion.

DETAILED DESCRIPTION OF THE INVENTION

Figure 1:
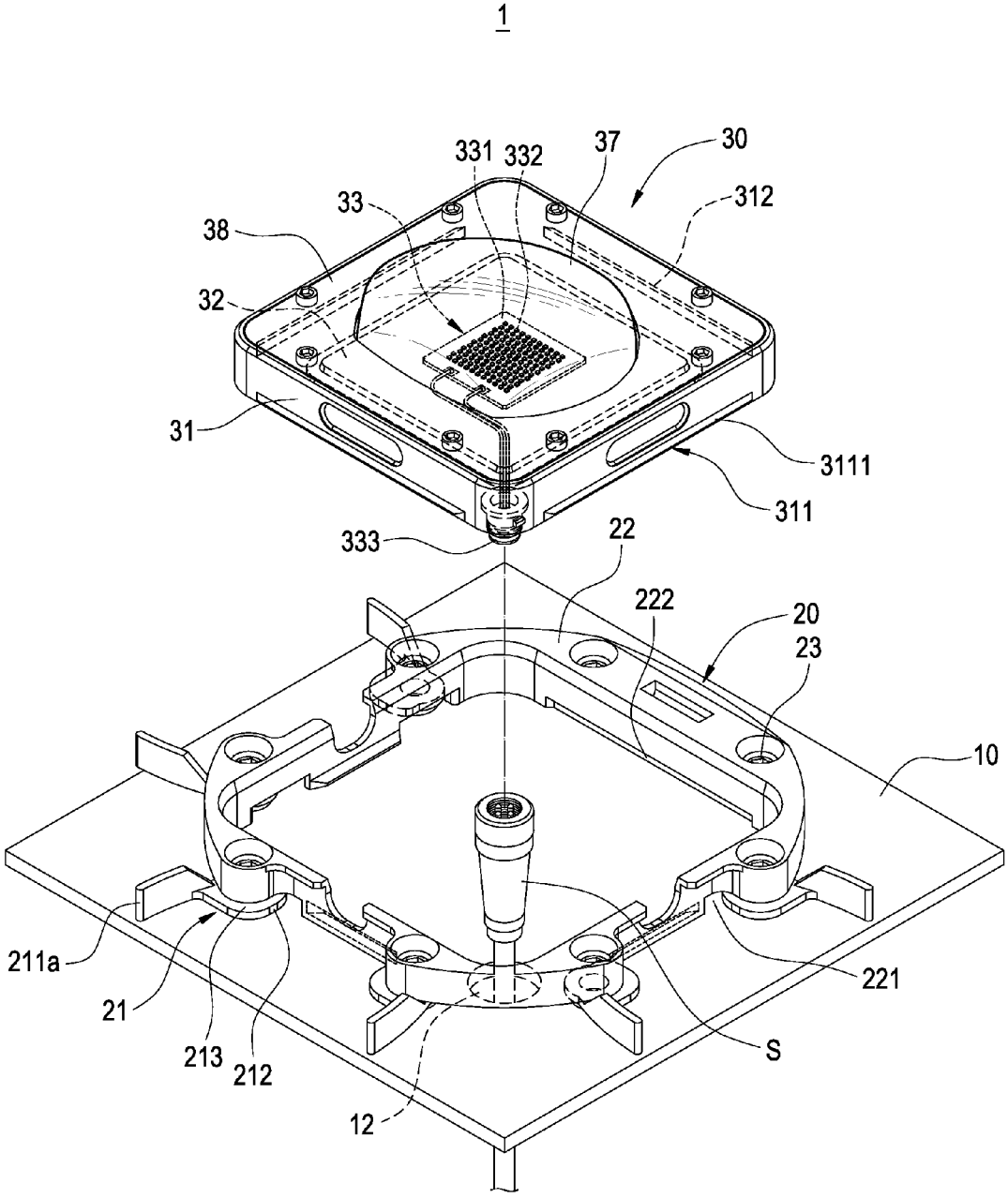
FIG. 1 is a perspective view of the first embodiment of the invention.

Please refer to FIG. 1. The detachable lamp 1 of the invention includes a seat 10, a fastening mechanism 20 and a lighting module 30.

Figure 2:
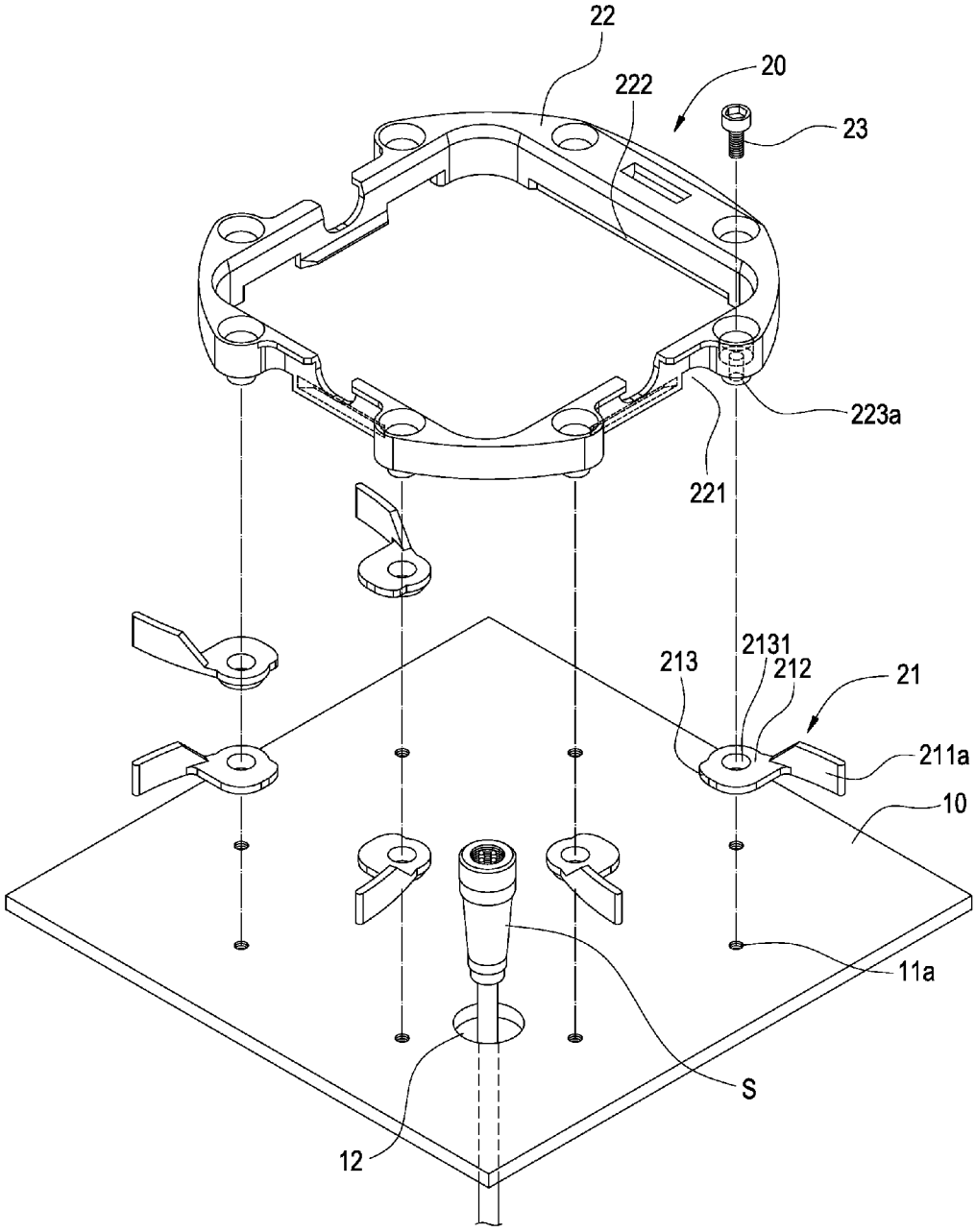
FIG. 2 is an exploded view of the fastening mechanism of the first embodiment of the invention.
Figure 3:
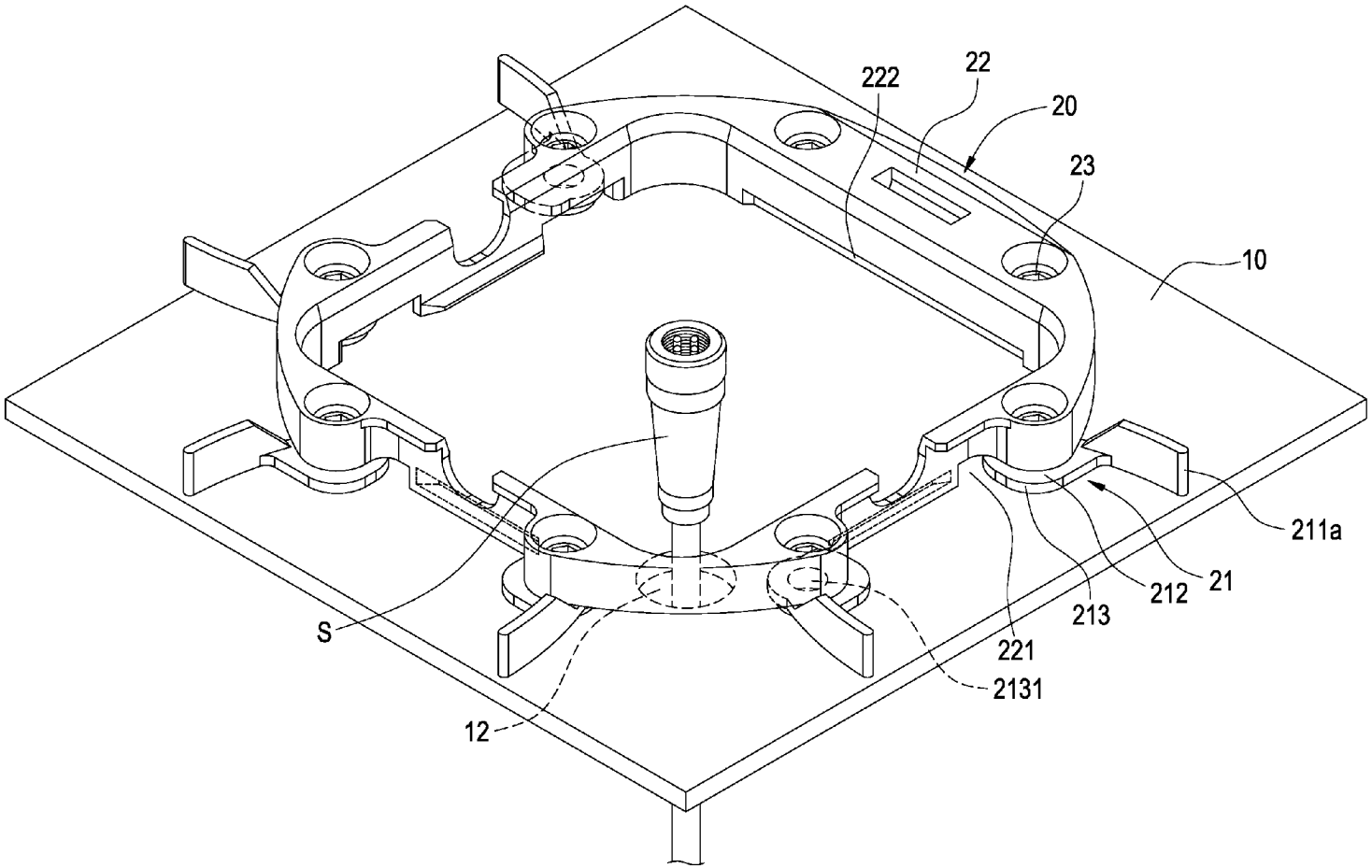
FIG. 3 is an assembled view of the fastening mechanism of the first embodiment of the invention.

Please refer to FIGS. 2 and 3. The seat 10 is provided with at least one a threaded hole 11 a and a through hole 12 for being passed through by a connector S of a power line. The seat 10 can be made of metal, plastic, ceramic or any other materials with high thermo-conductivity.

The fastening mechanism 20 includes a rotary latch 21, an annular frame 22 and a screwing element 23. The rotary latch 21 is pivotally connected between the seat 10 and the annular frame 22. The rotary latch 21 has a stem 211*a* and a latching portion 212. The latching portion 212 extends from the stem 211*a* and is a cam 213. At least one side of the annular frame 22 is formed with a passing trough 221 and the other side thereof is formed with an opened trough 222. The annular frame 22 is provided with at least one a hollow bar 223*a* corresponding to the threaded hole 11*a*. The cam 213 is provided with a pivot hole 2131 corresponding to the hollow bar 223*a* for pivotally receiving the hollow bar 223*a*. The screwing element 23 passes through the hollow bar 223*a* and is fastened into the threaded hole 11*a*. The screwing element 23 is a screw.

Figure 4:
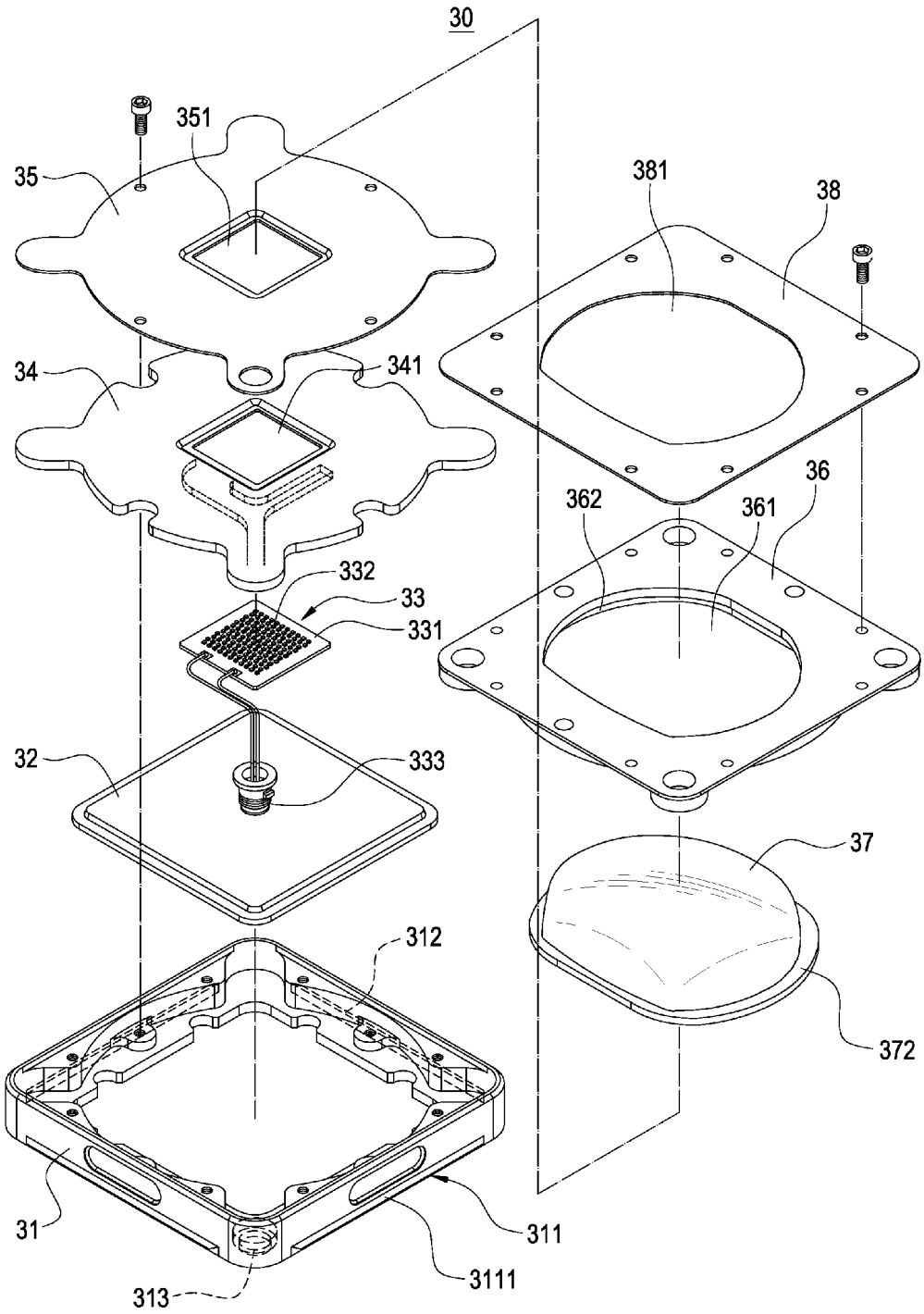
FIG. 4 is an exploded view of the lighting module of the first embodiment of the invention.
Figure 5:
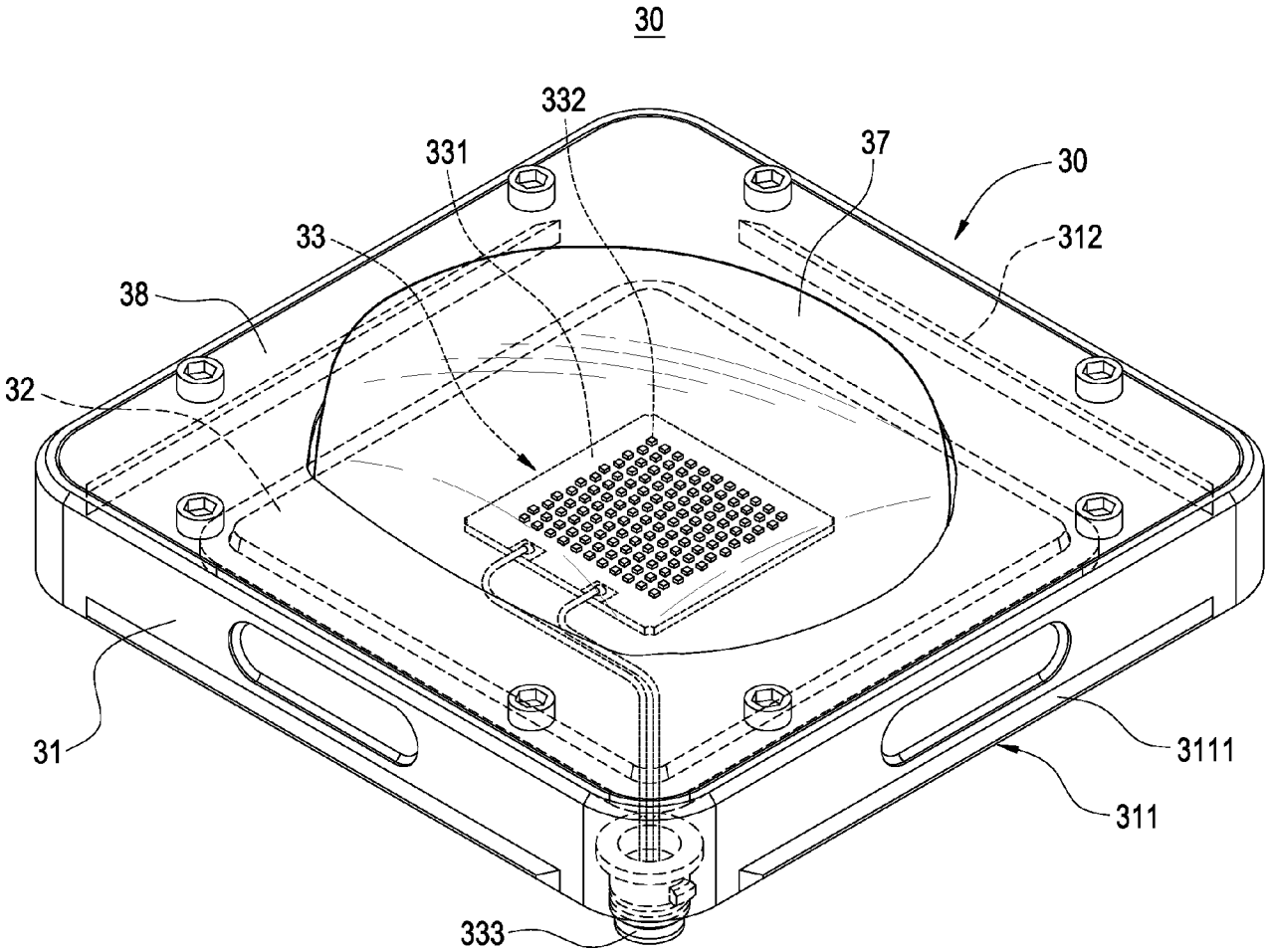
FIG. 5 is an assembled view of the lighting module of the first embodiment of the invention.
Figure 6:
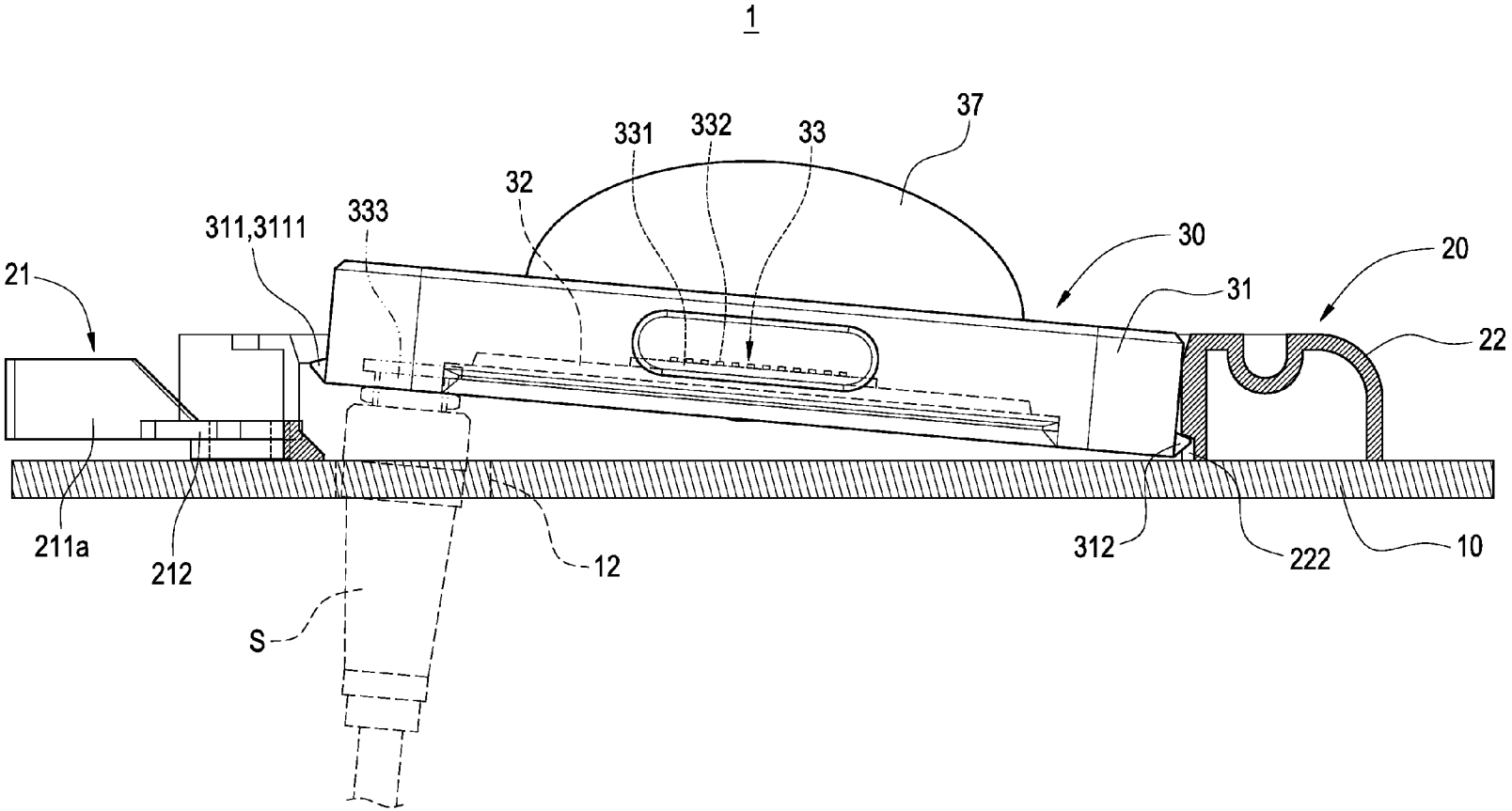
FIG. 6 is a first schematic view of the first embodiment of the invention in use.
Figure 7:
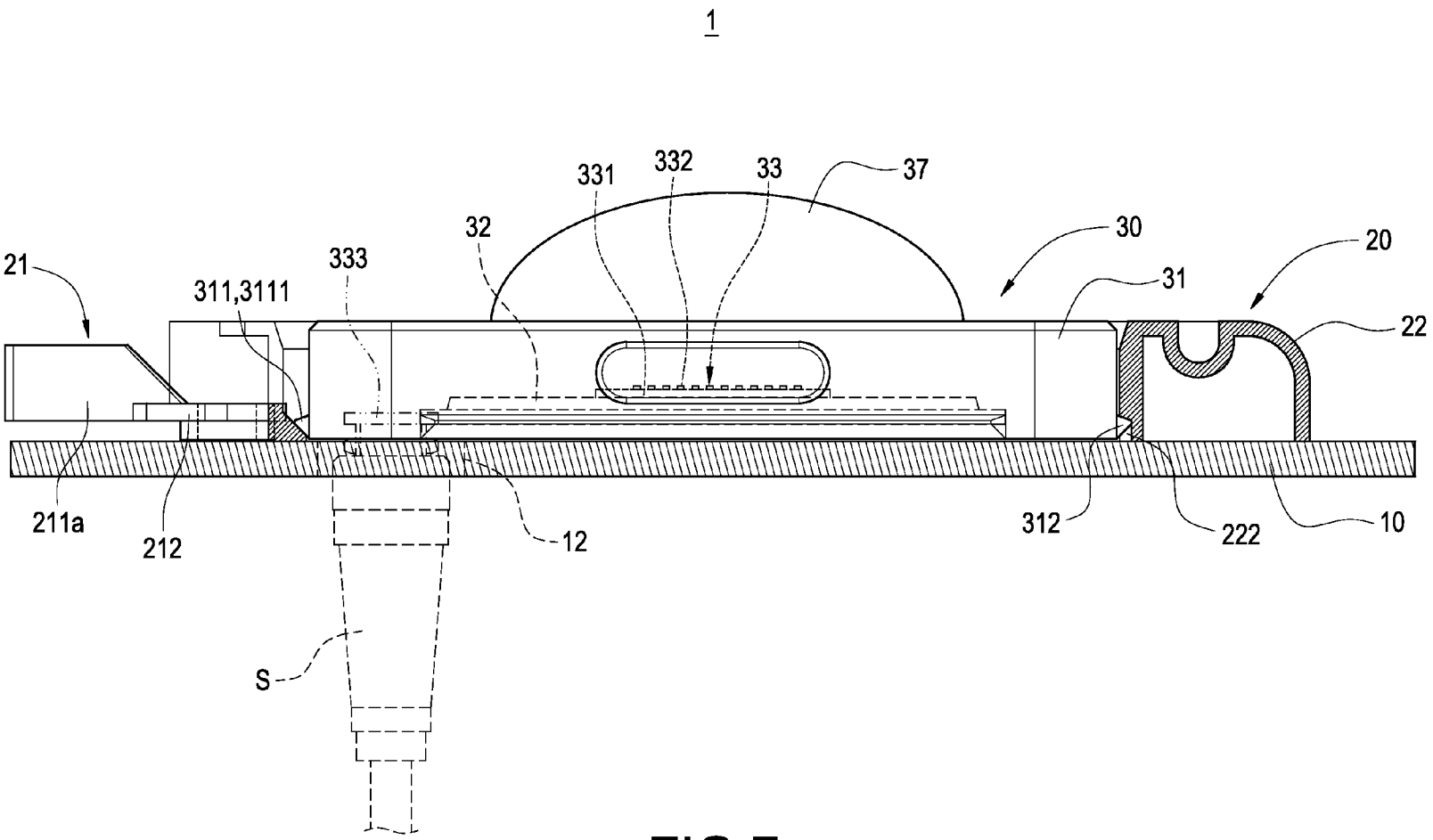
FIG. 7 is a second schematic view of the first embodiment of the invention in use.
Figure 8:
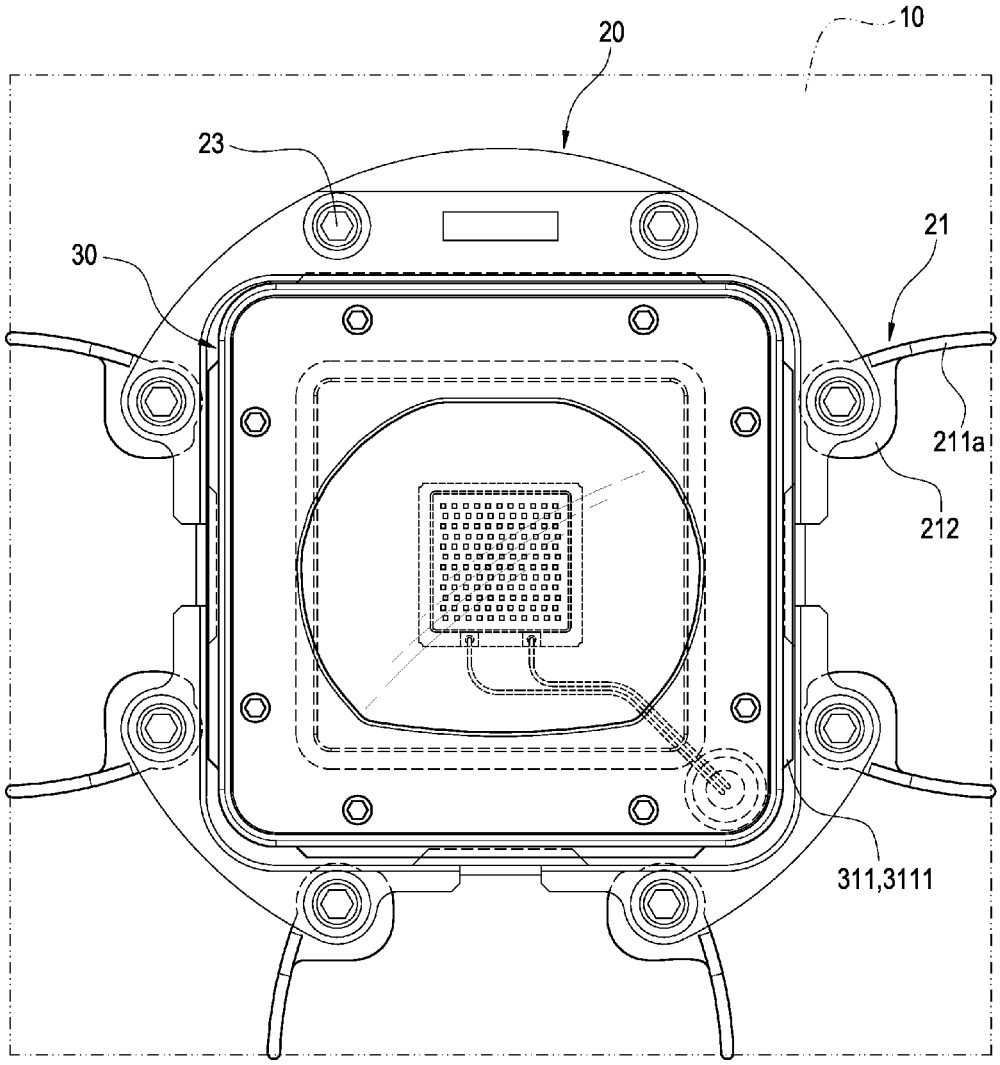
FIG. 8 is a third schematic view of the first embodiment of the invention.

Please refer to FIGS. 4 and 5. The lighting module 30 is put within the annular frame 22 and is disposed on the seat 10 corresponding by the fastening mechanism 20. The lighting module 30 includes a frame 31, vapor chamber 32, an LED assembly 33, a waterproof pad 34, a pressing plate 35, a cover 36, a hood 37 and a trimming plate 38.

The frame 31 has an engaging member 311 for being fastened by the latching portion 212 and a rib 312. The engaging member 311 is a strip 3111 protrudent from the frame 31 and corresponding to the passing trough 221 as shown in FIG. 1. As shown in FIG. 1, turning the rotary latch 21 can make the cam 213 rotate in and out the passing trough 221 and press the strip 3111. One of the other sides of the frame 31 is formed with a rib 312 corresponding to the opened trough 222. The rib 312 is engaged in the opened trough 222 as shown in FIG. 1. Besides, the frame 31 is form with a positioning hole 313.

The vapor chamber 32 is received in the frame 31 and one side of the vapor chamber 32 abuts against the seat 10 as shown in FIG. 1.

The LED assembly 33 is received in the frame 31. The LED assembly 33 includes a circuit board 331, at least one LED 332 and a plug 333. The circuit board 331 is in thermal contact with the vapor chamber 32. Thus, heat from the LED assembly 33 can be dissipated to the air or seat 10 as show in FIG. 1. The LED 332 and plug 333 electrically connect the circuit board 331. The plug 333 is located in the positioning hole 313.

The water proof pad 34 is made of silicone. The waterproof pad 34 is received in the frame 31 and cloaks the circuit board 331 and vapor chamber 32. The waterproof pad 34 is provided with an aperture 341 corresponding to the LED 332 for receiving the LED 332.

The pressing plate 35 is received in the frame 31 and cloaks and presses the waterproof pad 34. The pressing plate 35 is provided with an opening 351 corresponding to the LED 332.

Figure 9:
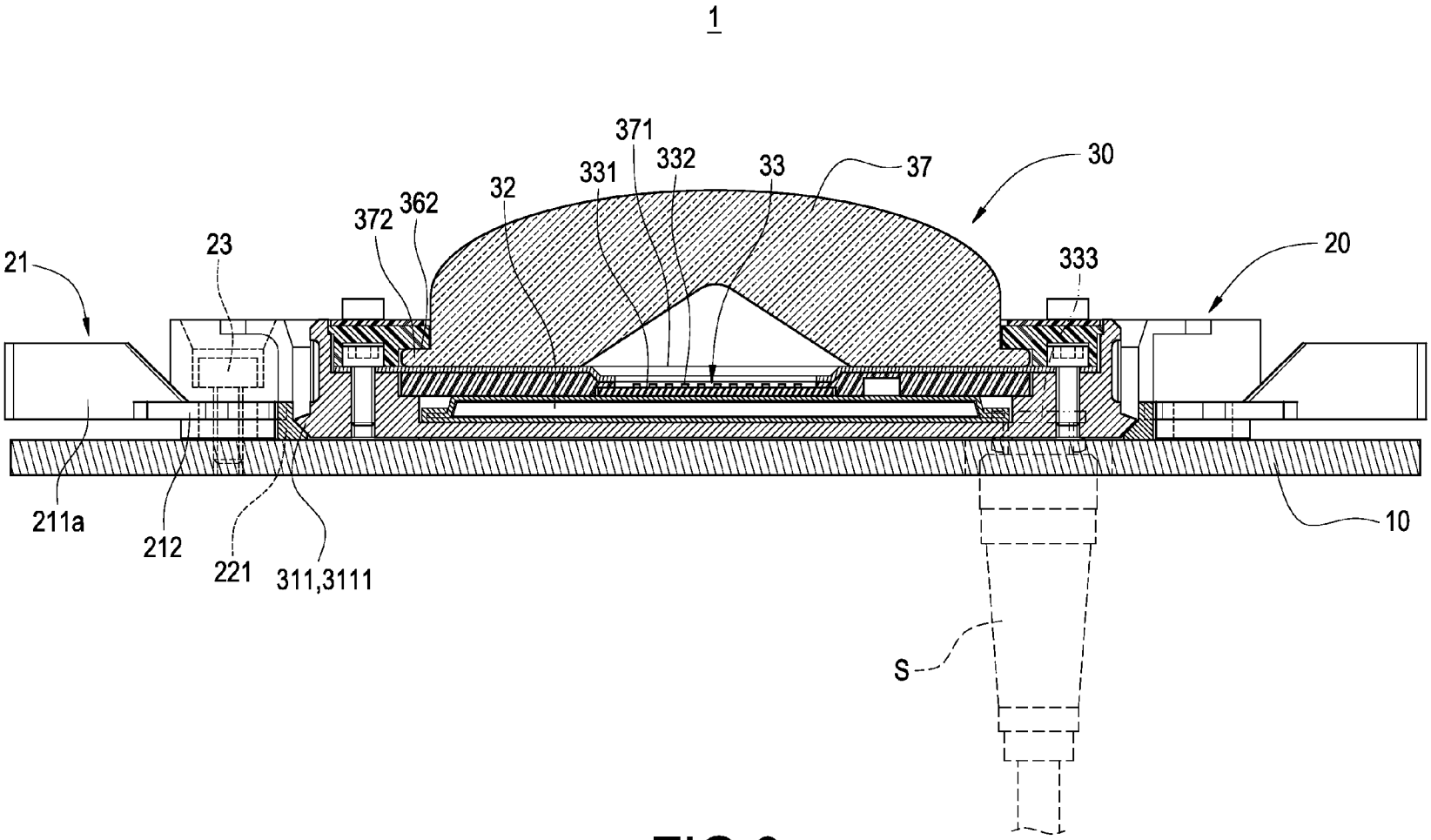
FIG. 9 is a fourth schematic view of the first embodiment of the invention in use.

The cover 36 cloaks the frame 31 and is provided with a receiving hole 361. As shown in FIG. 9, a recess 362 is formed around the edge of the receiving hole 362. The hood 37 has a space 371 and a flange 372 corresponding to the recess 362. The hood 37 passes through the receiving hole 361 and the flange 372 is received in the recess 362. The LED 332 emits light towards the hood 37.

The trimming plate 38 cloaks the cover 36 and has a hollow 381 for receiving the hood 37.

Please refer to FIGS. 6-9. The connector S passes through the through hole 12. The seat 10 is fixed on a ceiling or wall. The connector S is connected to the plug 333. The lighting module 30 is received in the annular frame 22. The rib 312 is received in the opened trough 222. The strip 3111 is disposed in the annular frame 22.

Figure 10:
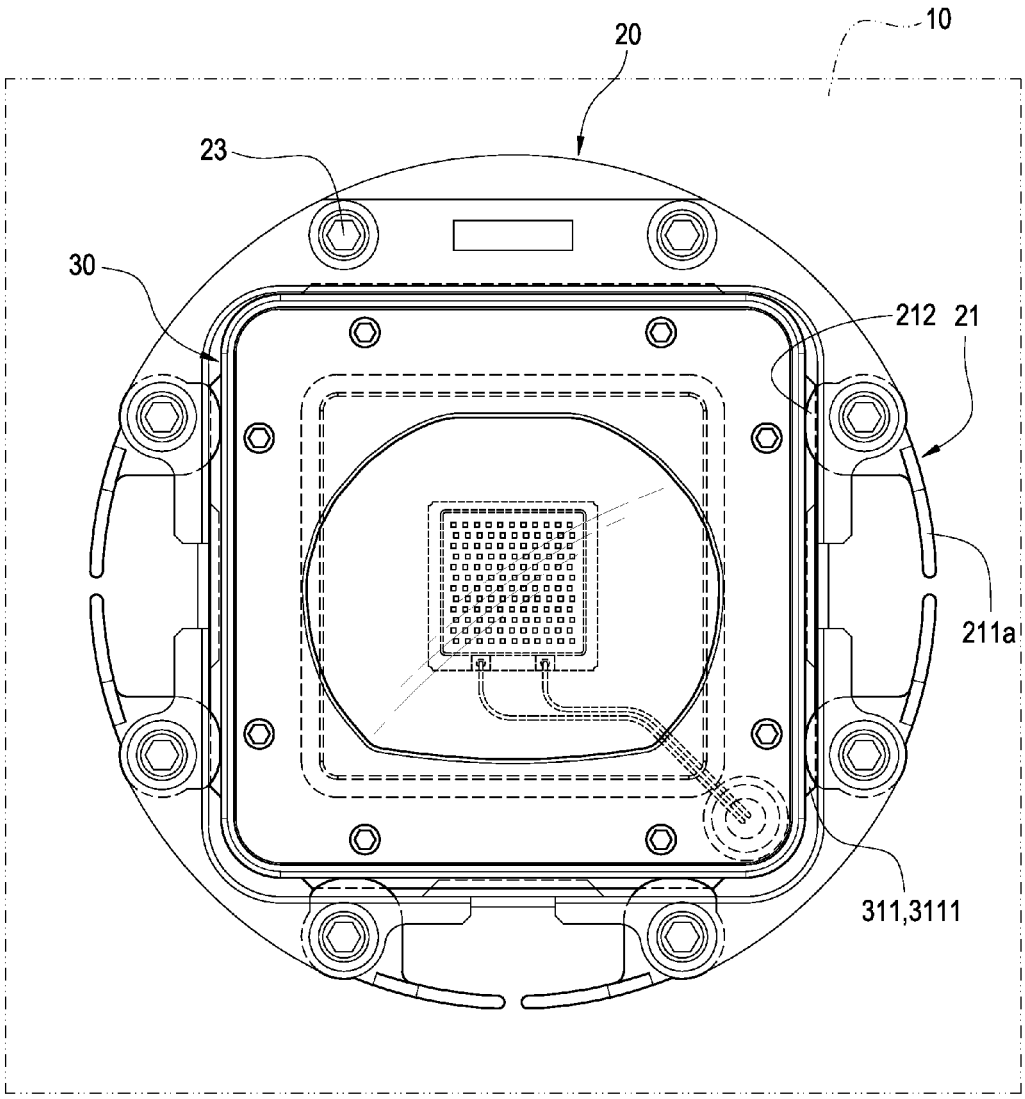
FIG. 10 is a fifth schematic view of the first embodiment of the invention in use.
Figure 11:
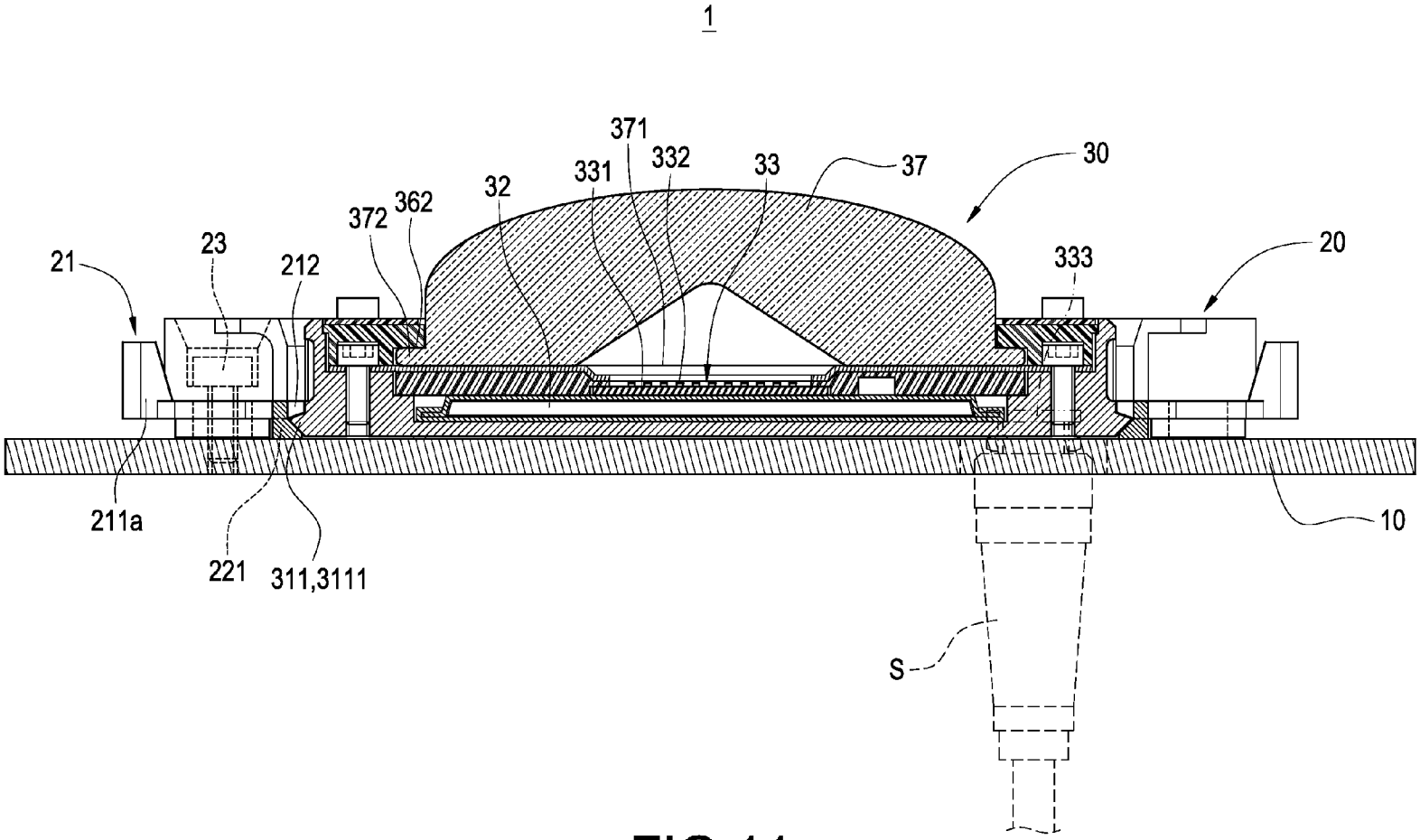
FIG. 11 is a sixth schematic view of the first embodiment of the invention in use.
Figure 12:
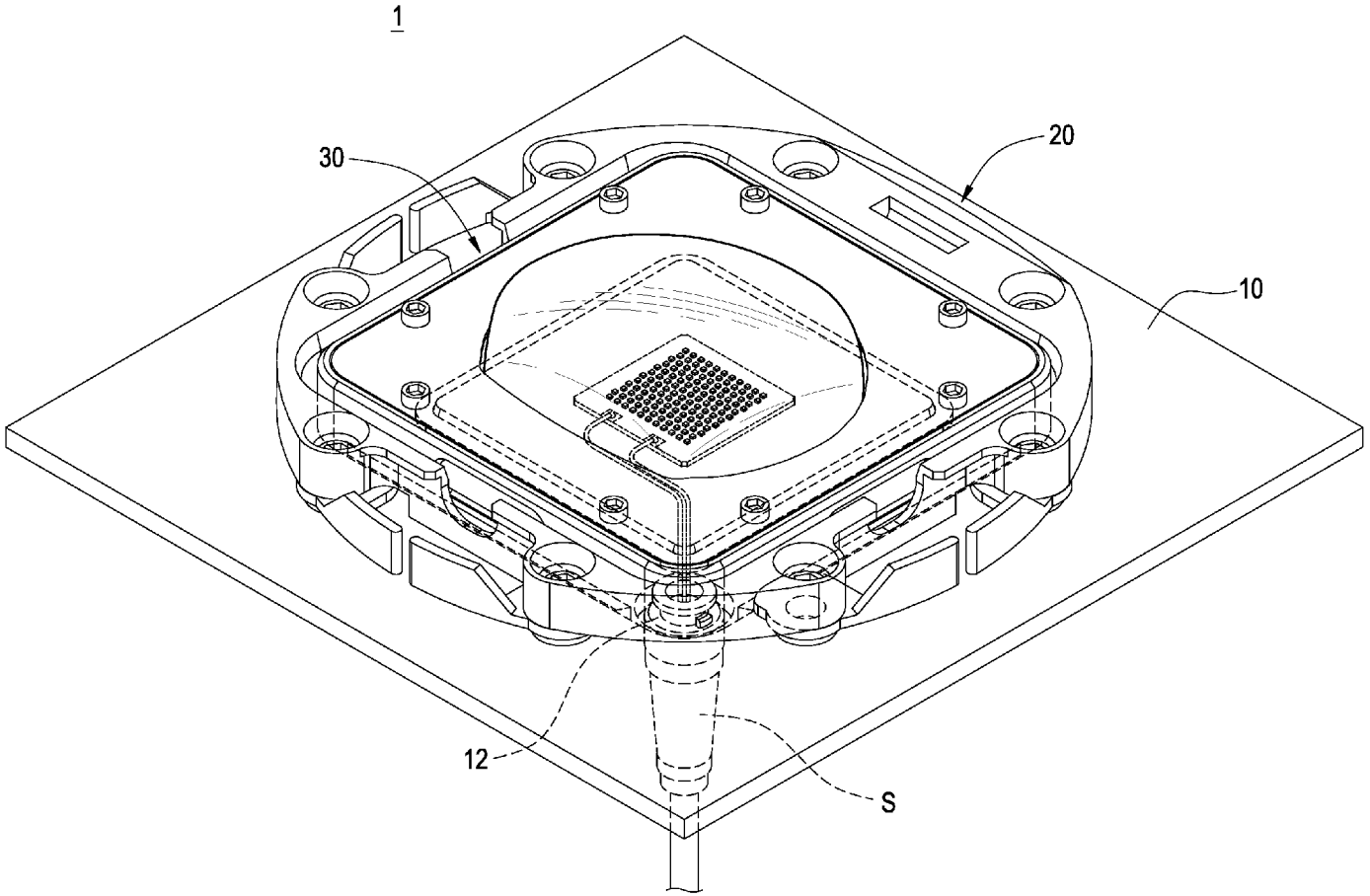
FIG. 12 is a seventh schematic view of the first embodiment of the invention in use.

Please refer to FIGS. 10-12. The rotary latch 21 can be rotated by rotating the stem 211*a* to press the strip 3111 so that the lighting module 30 can be fixed on the seat 10.

Because the seat 10 is mounted on the ceiling or wall, the ceiling or wall does not need to be drilled. It is easy to be installed. The lighting module 30 can be simply replaced with a new one.

Figure 13:
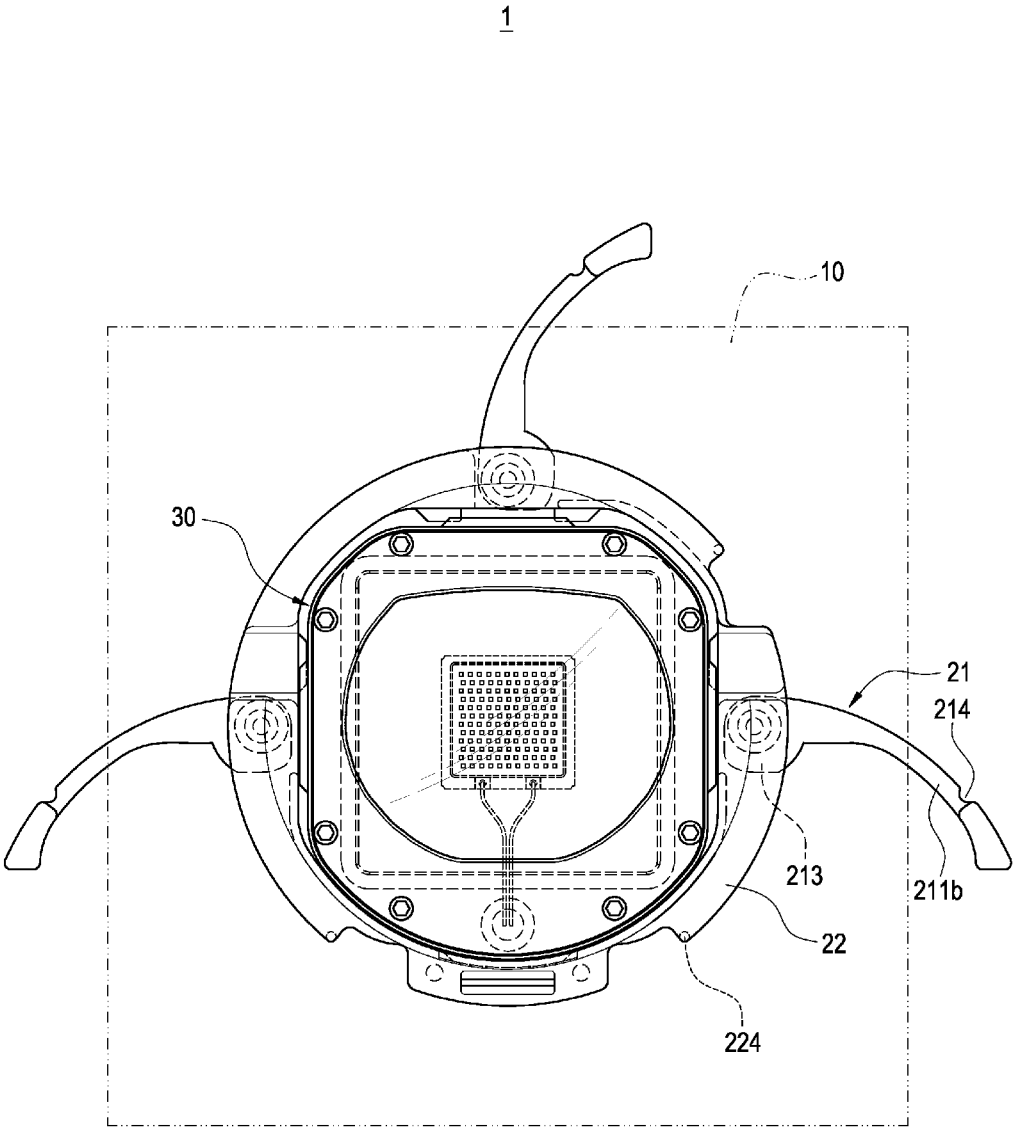
FIG. 13 is an assembled view of the second embodiment of the invention.
Figure 13A:
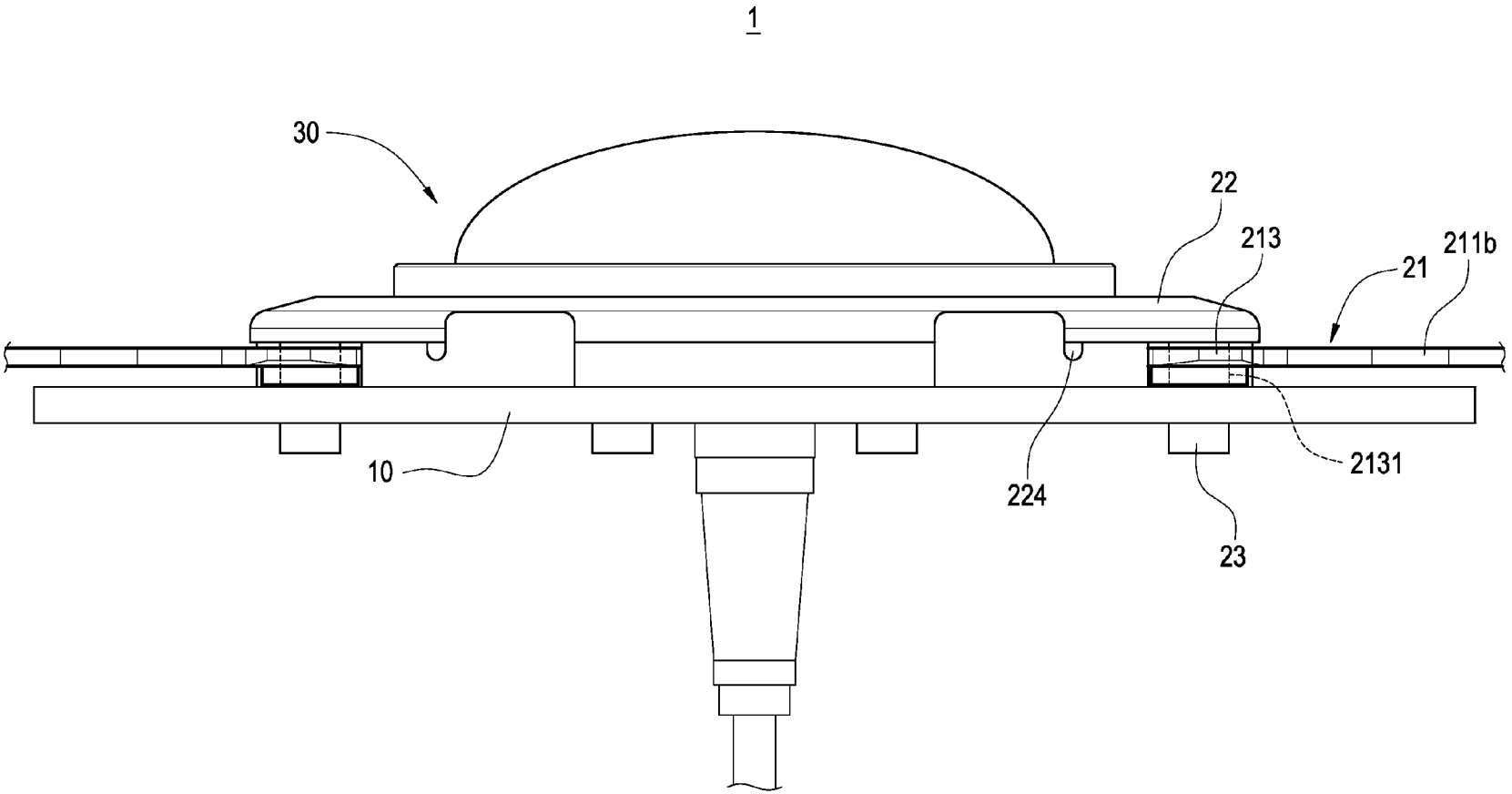
FIG. 13A is a first sectional view of FIG. 13.
Figure 13B:
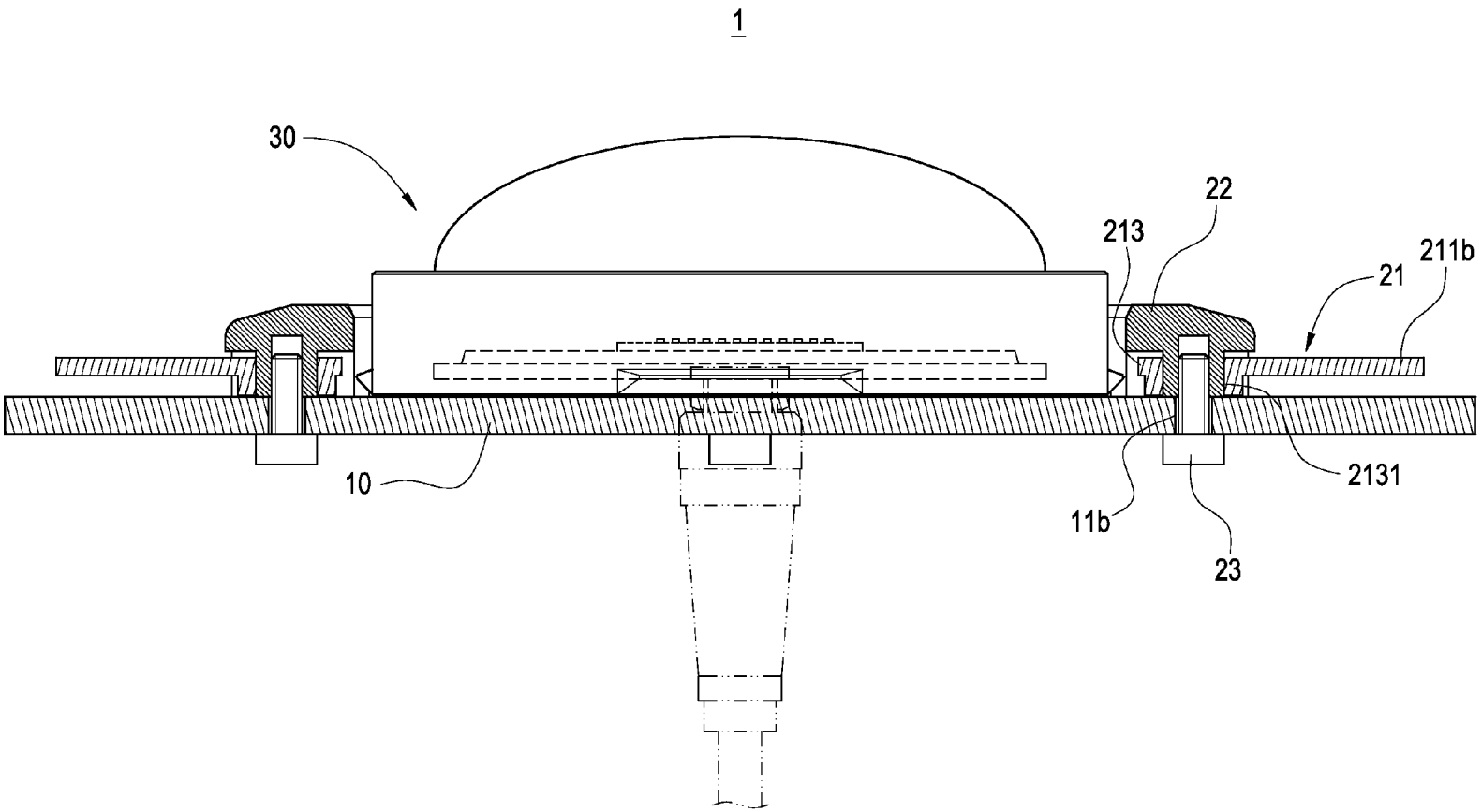
FIG. 13B is a second sectional view of FIG. 13.

Please refer to FIGS. 13, 13A and 13B, which show the second embodiment of the invention. In this embodiment, the stem 211*b* has a longer length and is formed with a dent 214 and the annular frame 22 is formed with a protrusion 224 which can be embedded into the dent 214.

Figure 14:
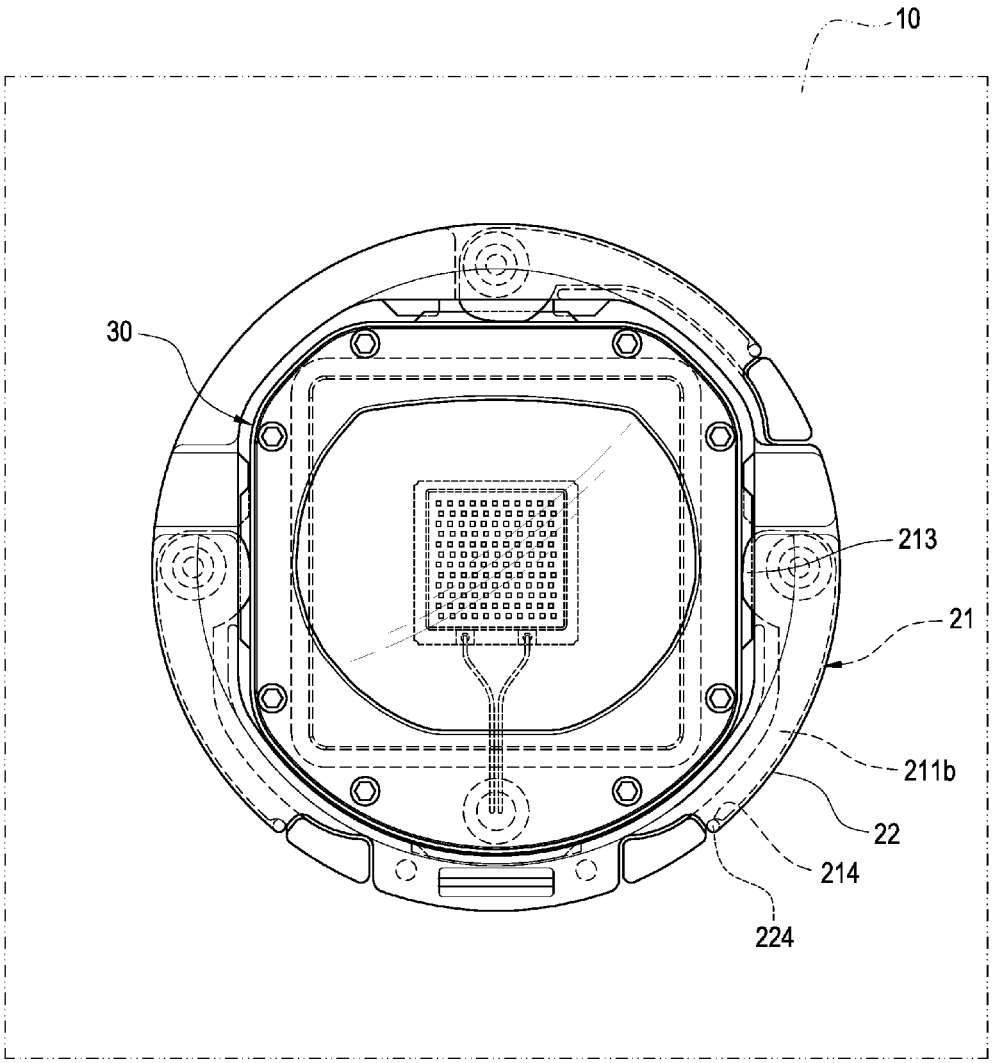
FIG. 14 is a schematic view of the second embodiment of the invention in use.
Figure 14A:
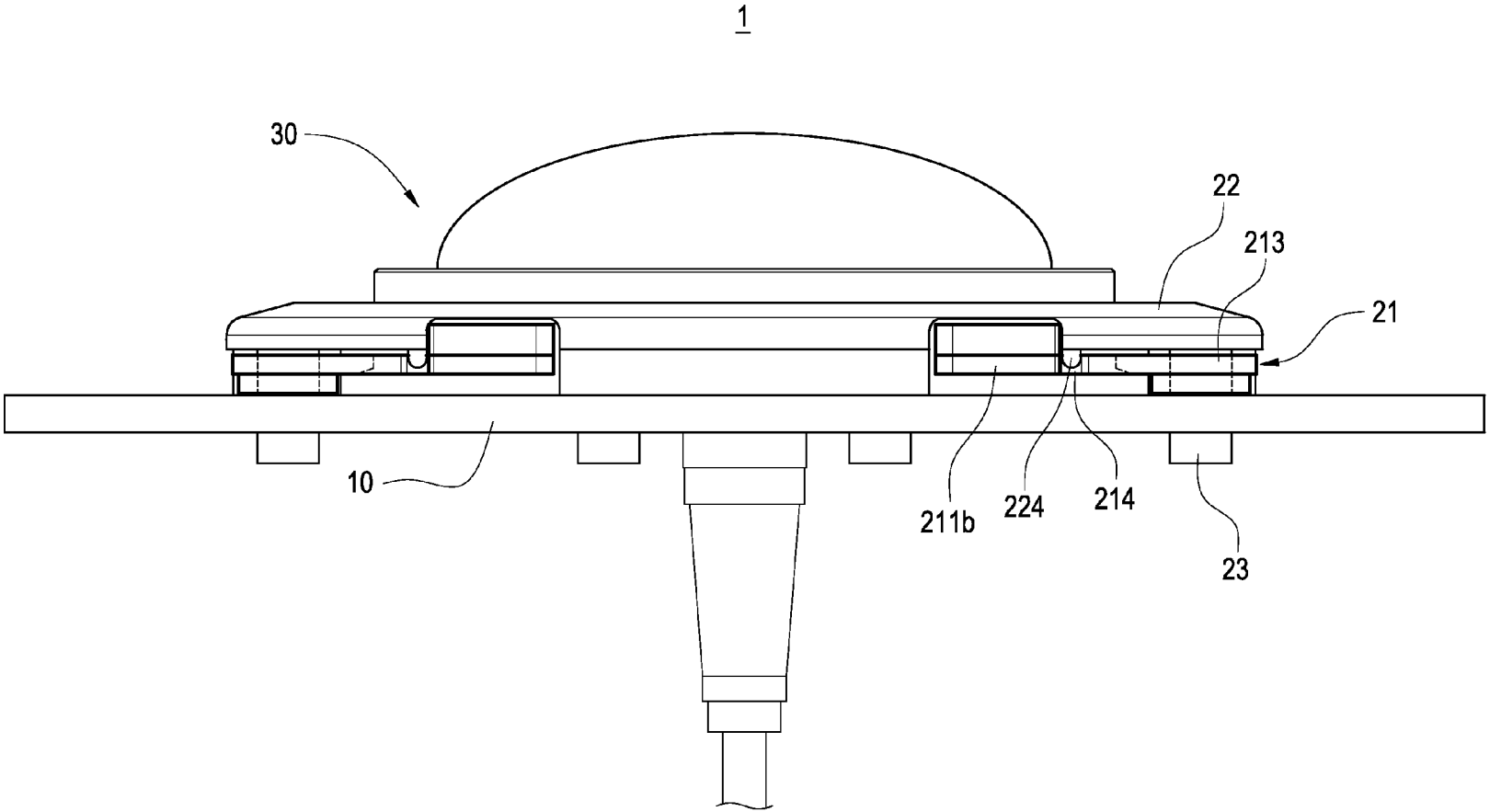
FIG. 14A is a first sectional view of FIG. 14.
Figure 14B:
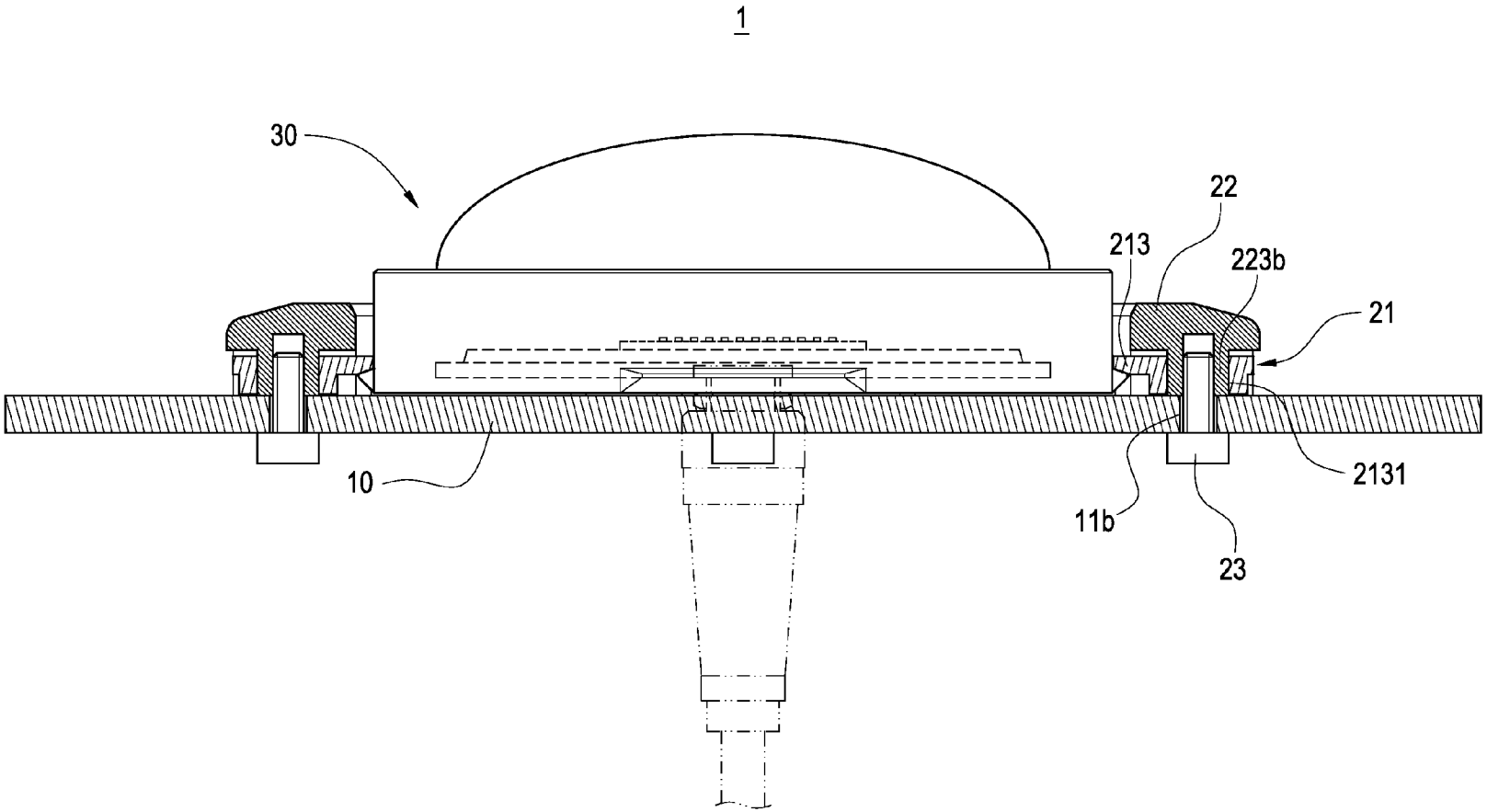
FIG. 14B is a second sectional view of FIG. 14.

Please refer to FIGS. 14, 14A and 14B. The protrusion 224 can be embedded into the dent 214 by rotating the stem 211*b*. As a result, the cam 213 can be prevented from reversely rotating.

Besides, the threaded hole 11*a* is replaced with a through hole 11*b* and the hollow bar 223*a* is replaced with a hollow inner threaded bar 223*b*. The hollow inner threaded bar 223*b* is pivotally connected in the pivot hole 2131. The screwing element 23 passes the through hole 11*b* and is fastened to the hollow inner threaded bar 223*b*. Thus, the screwing element 23 can be hidden in the annular frame 22.

It will be appreciated by persons skilled in the art that the above embodiments have been described by way of example only and not in any limitative sense, and that various alterations and modifications are possible without departure from the scope of the invention as defined by the appended claims.

What is claimed is:

1. A detachable lamp comprising:

a seat;

a fastening mechanism, comprising a rotary latch having a stem and a latching portion extending from the stem; and a lighting module, disposed on the seat corresponding by the fastening mechanism, comprising a frame and a light emitting diode (LED) assembly received in the frame, and the frame having an engaging member for being fastened by the latching portion.

2. The detachable lamp of claim 1, wherein the fastening mechanism further comprises an annular frame, the lighting module is received in the annular frame, and the rotary latch is pivotally connected between the seat and the annular frame.

3. The detachable lamp of claim 2, wherein the annular frame is formed with an opened trough, and the frame is formed with a rib engaging with the opened trough.

4. The detachable lamp of claim 3, wherein the latching portion is a cam, the annular frame is formed with a passing trough, the engaging member is a strip protrudent from the frame, and the frame presses strip.

5. The detachable lamp of claim 4, wherein the annular frame is formed with a protrusion, and the stem is formed with a dent corresponding to the protrusion.

6. The detachable lamp of claim 4, wherein the fastening mechanism comprising a screwing element, the seat has a threaded hole, the annular frame has a hollow bar, the cam has a pivot hole for pivotally receiving the hollow bar, and the screwing element passes the hollow bar and is fastened into the threaded hole.

7. The detachable lamp of claim 4, wherein the fastening mechanism comprising a screwing element, the seat has a through hole, the annular frame has a hollow inner threaded bar, the cam has a pivot hole for pivotally receiving the hollow inner threaded bar, and the screwing element passes the through hole and is fastened into the hollow inner threaded bar.

8. A detachable lamp comprising:

a seat;

a fastening mechanism, comprising a rotary latch having a stem and a latching portion extending from the stem; and a lighting module, disposed on the seat corresponding by the fastening mechanism, comprising a frame, a vapor chamber received in the frame and a light emitting diode (LED) assembly being in contact with the vapor chamber, and the frame having an engaging member for being fastened by the latching portion.

9. The detachable lamp of claim 8, wherein the fastening mechanism further comprises an annular frame, the lighting module is received in the annular frame, and the rotary latch is pivotally connected between the seat and the annular frame.

10. The detachable lamp of claim 9, wherein the annular frame is formed with an opened trough, and the frame is formed with a rib engaging with the opened trough.

11. The detachable lamp of claim 10, wherein the latching portion is a cam, the annular frame is formed with a passing trough, the engaging member is a strip protrudent from the frame, and the frame presses strip.

12. The detachable lamp of claim 11, wherein the annular frame is formed with a protrusion, and the stem is formed with a dent corresponding to the protrusion.

13. The detachable lamp of claim 12, wherein the fastening mechanism comprising a screwing element, the seat has a threaded hole, the annular frame has a hollow bar, the cam has a pivot hole for pivotally receiving the hollow bar, and the screwing element passes the hollow bar and is fastened into the threaded hole.

14. The detachable lamp of claim 12, wherein the fastening mechanism comprising a screwing element, the seat has a through hole, the annular frame has a hollow inner threaded bar, the cam has a pivot hole for pivotally receiving the hollow inner threaded bar, and the screwing element passes the through hole and is fastened into the hollow inner threaded bar.

15. The detachable lamp of claim 8, wherein the vapor chamber abuts against the seat, and the LED assembly comprises a circuit board being in thermal contact with the vapor chamber.

16. The detachable lamp of claim 15, wherein the lighting module comprises a waterproof pad, the LED assembly comprises at least one LED electrically connected to the circuit board, the waterproof pad is received in the frame and cloaks the circuit board and vapor chamber, and the waterproof pad is provided with an aperture corresponding to the LED for exposing the LED.

17. The detachable lamp of claim 16, wherein the lighting module comprises a pressing plate, the pressing plate is received in the frame and cloaks and presses the waterproof pad, and the pressing plate is provided with an opening for exposing the LED.

18. The detachable lamp of claim 17, wherein the lighting module comprises a cover and a hood, the cover cloaks the frame and is provided with a receiving hole, and the hood passes through the receiving hole.

19. The detachable lamp of claim 18, wherein the lighting module comprises a trimming plate cloaking the cover and having a hollow for receiving the hood.

20. The detachable lamp of claim 8, wherein the LED assembly comprises a plug, the frame has a positioning hole, the plug electrically connects the circuit board and passes through the positioning hole.

* * * * *